US011758621B2

(12) United States Patent
Dietschi et al.

(10) Patent No.: US 11,758,621 B2
(45) Date of Patent: Sep. 12, 2023

(54) SYSTEM AND METHOD FOR OHMIC HEATING OF A FLUID

(71) Applicant: InstaHeat AG, Zurich (CH)

(72) Inventors: Fabian Dietschi, Zurich (CH); Alexei Gromov, Zurich (CH)

(73) Assignee: InstaHeat AG, Zurich (CH)

( * ) Notice: Subject to any disclaimer, the term of this patent is extended or adjusted under 35 U.S.C. 154(b) by 1016 days.

(21) Appl. No.: 16/499,940

(22) PCT Filed: Mar. 27, 2018

(86) PCT No.: PCT/EP2018/057771
§ 371 (c)(1),
(2) Date: Oct. 1, 2019

(87) PCT Pub. No.: WO2018/184914
PCT Pub. Date: Oct. 11, 2018

(65) Prior Publication Data

US 2020/0205237 A1 Jun. 25, 2020

(30) Foreign Application Priority Data

Apr. 3, 2017 (DE) ..... 10 2017 205 596.0

(51) Int. Cl.
*H05B 3/60* (2006.01)
*H05B 1/02* (2006.01)
*H05B 3/00* (2006.01)

(52) U.S. Cl.
CPC ..... *H05B 3/60* (2013.01); *H05B 1/0297* (2013.01); *H05B 3/0023* (2013.01); *H05B 2203/021* (2013.01)

(58) Field of Classification Search
None
See application file for complete search history.

(56) References Cited

U.S. PATENT DOCUMENTS 421,499 A * 2/1890 Hubinger ..... F22B 1/30 392/338
1,760,230 A * 5/1930 Crawley ..... F24H 1/106 392/323
3,053,964 A 9/1962 Foley et al.
3,796,857 A * 3/1974 Henley ..... F24H 1/106 392/338

(Continued)

FOREIGN PATENT DOCUMENTS

CN 85105121 A * 2/1987
CN 1370261 A 9/2002

(Continued)

*Primary Examiner* — Thor S Campbell
(74) *Attorney, Agent, or Firm* — THE WEBB LAW FIRM

(57) ABSTRACT

Disclosed is a system for ohmic heating of a fluid which includes at least one chamber for receiving the fluid and at least two units each including at least one electrode. Each of the at least one electrode is associated to at least one device for galvanic separation. The electrodes of each of the two units are disposed in the chamber at a distance apart from one another and the device for galvanic separation is disposed outside of the chamber. The system also includes at least one frequency inverter that is electrically connected to the at least two electrode-units for operating the at least two electrode-units.

19 Claims, 11 Drawing Sheets

(56) References Cited

U.S. PATENT DOCUMENTS

| | | | | | |
|---|---|---|---|---|---|
| 3,909,588 | A * | 9/1975 | Walker | G05D 23/1906 | 392/318 |
| 3,925,638 | A * | 12/1975 | Scatoloni | F24H 1/106 | 392/338 |
| 3,978,313 | A * | 8/1976 | Curchod | F24H 1/106 | 392/338 |
| 4,036,716 | A * | 7/1977 | Hulthe | F22B 1/30 | 205/729 |
| 4,119,833 | A * | 10/1978 | Welch | F24H 1/106 | 392/338 |
| 4,434,357 | A * | 2/1984 | Simpson | A23L 3/005 | 426/247 |
| 5,440,667 | A * | 8/1995 | Simpson | F24H 1/106 | 392/314 |
| 6,130,990 | A | 10/2000 | Herrick et al. | | |
| 6,246,831 | B1 * | 6/2001 | Seitz | F24H 9/2021 | 219/483 |
| 6,522,834 | B1 | 2/2003 | Herrick et al. | | |
| 6,678,470 | B1 * | 1/2004 | Hoshino | H05B 3/0009 | 392/311 |
| 7,050,706 | B2 * | 5/2006 | Israelsohn | H05B 3/44 | 392/314 |
| 9,741,487 | B2 | 8/2017 | Waffenschmidt et al. | | |
| 2008/0186742 | A1 | 8/2008 | Seong | | |
| 2009/0263113 | A1 | 10/2009 | Bierbaumer et al. | | |
| 2010/0074602 | A1 | 3/2010 | Israelsohn et al. | | |
| 2010/0322605 | A1 | 12/2010 | van Aken et al. | | |
| 2011/0236004 | A1 | 9/2011 | Bowers et al. | | |
| 2012/0114009 | A1 * | 5/2012 | Melvin | H02M 3/33573 | 373/150 |
| 2012/0312886 | A1 | 12/2012 | Artmayr | | |
| 2013/0129327 | A1 | 5/2013 | Israelsohn et al. | | |
| 2014/0321836 | A1 * | 10/2014 | Kacar | H05B 3/60 | 392/316 |
| 2015/0098252 | A1 * | 4/2015 | Spinella | H02M 3/33507 | 363/21.01 |

FOREIGN PATENT DOCUMENTS

| | | | | | |
|---|---|---|---|---|---|
| CN | 101663543 | A | | 3/2010 | |
| CN | 103477158 | A | | 12/2013 | |
| EP | 0476311 | A1 | | 3/1992 | |
| EP | 1417444 | B1 | | 4/2010 | |
| GB | 1161366 | | | 8/1969 | |
| GB | 2268671 | A | * | 1/1994 | F24H 1/106 |
| JP | 200117131 | A | | 1/2001 | |
| JP | 3096319 | U | | 9/2003 | |
| JP | 200726814 | A | | 2/2007 | |
| JP | 2008541689 | A | | 11/2008 | |
| JP | 2012100525 | A | | 5/2012 | |
| JP | 201592866 | A | | 5/2015 | |
| JP | 2015515850 | A | | 5/2015 | |
| WO | 2006108198 | A1 | | 10/2006 | |
| WO | 2009100486 | A1 | | 8/2009 | |
| WO | 2013024404 | A2 | | 2/2013 | |
| WO | WO-2015062605 | A1 | * | 5/2015 | F24H 1/106 |

* cited by examiner

SYSTEM AND METHOD FOR OHMIC HEATING OF A FLUID

CROSS-REFERENCE TO RELATED APPLICATIONS

This application is the United States national phase of International Application No. PCT/EP2018/057771 filed Mar. 27, 2018, and claims priority to German Patent Application No. 10 2017 205 596.0 filed Apr. 3, 2017, the disclosures of which are hereby incorporated by reference in their entirety.

BACKGROUND OF THE INVENTION

Field of the Invention

The disclosure relates to a system for ohmic heating a fluid and a method for ohmic heating a fluid using this system.

Description of Related Art

Methods of electrical heating are well known. Electrical heating systems and methods can be subdivided into resistance heating, arc heating, induction heating, dielectric heating, infrared heating, external heating, laser heating and combinations thereof.

In case of ohmic heating an electrical potential is applied to a liquid by means of two electrodes generating a current flow (electron flow) through the liquid. The electrons flowing through the liquid collide with the atomic nuclei of the liquid and give off their kinetic energy. This increases the kinetic energy (temperature) of the atomic nuclei and thus increases the temperature of the liquid.

Ohmic heating (or Joule heating) of fluidic systems is a well-established method. For example, U.S. Pat. No. 3,053,964 describes a fluid heater in which the electrodes are immersed in the conductive fluid to be heated and the resistance of the fluid itself in the electric circuit is utilized for producing heat. The electric energy is supplied in a gradual and discontinuing manner accomplished by a pair of electric contact points, wherein one of these contact points is stationary in the water at a substantial distance below normal water level in the heater and is in electrical connection with one electrode. The other contact point is movable between a position below the surface of the water in contact with the first contact point and a second position in an air pocket or pocket of other nonconductive gas maintained in the housing of the heater above the surface of the liquid.

In today's application of ohmic heating, mainly the following challenging problems arise. First, in order to provide sufficient energy for ohmic heating of a fluid without large transformation losses typically the mains voltage is directly applied to the electrodes. However, this causes a leakage current if the processed fluid is in contact with a grounded object (connected to earth). This can trigger the earth leakage circuit breaker or residual current device of the installation or in their absence it can provide a lethal electrical shock to a person. Second, to achieve a small and compact ohmic heating device with sufficient heating performance a high-power density setup is required. To realize such a design, the fluid needs to be subjected to high energies that corrode the electrodes and alter the fluid causing a degradation of the taste or formation of dangerous by-products when using the mains voltage. Third, the control of the applied heating power to reach a desired outlet temperature of the fluid. Last, the most important parameter for the ohmic heating process is the conductivity of the fluid. However, this physical property is dependent on the fluid temperature and specific composition of it. This results in a large variation of the conductivity even for the same type of fluid. For instance, the conductivity of tap water varies by a factor of ten just depending on the geographic location. To build a practical ohmic heating device it must be capable of handling such variations.

Today's applications of ohmic heating are mostly found in the food processing industry at a large scale. In this industrial environment, large machines with a low power density are used or no personal get in contact with the processed fluid. Additionally, the processed food is normally known beforehand and the machine is built for the specific application. Therefore, the mentioned issues are not of relevance in industrial applications.

However, if ohmic heating is used in a smaller non-industrial application these issues must be considered. As of today, the issues are addressed as follows:

Leakage Current

Various methods are proposed in order to prevent or limit a leakage current flowing out of the device. For instance, US 2011/0236004 A1 describes grounding electrodes placed at the inlet and outlet of the device. These electrodes are connected to the electrical ground to ensure the liquid flowing in and out of the device is at ground potential to prevent an electrical shock. The disadvantage of this method is that these grounding electrodes need to be placed far enough away from the heating electrodes to ensure a limited ground current. To ensure compliance with electric regulations, making the device larger. In EP1417444B1, instead of electrodes the preferred metallic outlet and inlet tubes are proposed to be connected with earth straps to the electric ground, having the same disadvantage.

Other approaches are described in U.S. Pat. No. 6,522,834 B1, where the liquid is mechanically separated from the heating electrodes in order to break the connection of the outflowing liquid and the heating electrodes to prevent an electrical shock and a leakage current. For instance, two additional containers at the outlet separated by two valves which alternately open and close to deliver electrically neutral water. Another proposed concept consists of an in-line valve that opens and closes rapidly to deliver electrically neutral water. The disadvantage of these method is that it causes a discontinuous flow and requires additional mechanical parts.

Alteration of the Fluid and Corrosion

To reduce the alteration of the fluid and corrosion of the electrodes, U.S. Pat. No. 6,522,834 B1 proposes to keep the current density in the fluid and electrode suitably low. This is achieved by keeping the conducting area of the heating electrodes sufficiently large. A second approach is also described in the same patent, in which the applied voltage across the electrodes is boosted by a factor of two with a transformer placed between the voltage supply and electrodes. This results in a current density reduction by the same factor since the applied current is proportional to the ratio of the heating power and applied voltage. The requirement of making the conducting electrode area as large as possible results in a relatively large device. Using a voltage transformer as describe, requires a large and expensive one.

Heating Power Control and Conductivity Management

The heating power control and coping with the variation of the fluid conductivity are mostly handled the same way. US2011/236004A1 and WO2009/100486A1 propose a similar concept of having multiple electrodes which can be activated separately to control the active conduction area. By increasing the active conduction area, one can either compensate for a decreased conductivity to keep the same heating power or increase the heating power when the conductivity remains the same. Vice versa, by decreasing the active conduction area, one can either compensate for an increased conductivity or decrease the applied heating power.

U.S. Pat. No. 6,522,834 B1 additionally proposes a variable voltage supply between the mains supply and the electrodes to have an additional means to control the heating power or counter conductivity changes by increasing the voltage to compensate for a decrease in conductivity or increase the heating power and vice versa. The use of multiple electrodes is a cost-efficient method where the mains voltage can directly be used as the supply. However, this setup requires a lot of space. Using an additional voltage converter reduces the number of required electrodes but adds an expensive voltage converter.

SUMMARY OF THE INVENTION

In summary, to address the above-mentioned challenges an instantaneous liquid heater based on ohmic heating needs to be constructed in a way that is large enough to keep the current density low and cope with the conductivity variations that occur; or use additional large and expensive components.

Thus, the disadvantages of the methods and devices known for electrically heating fluids is the large design and high costs and energy intensity of the heating process connected therewith.

An object underlying the proposed solution is therefore to provide a heating system, such as an instantaneous water heater, based on the principle of ohmic heating with a high-power density, thus more compact and more cost-efficient.

This object is solved by a system for ohmic heating a fluid with features as described herein and a method for ohmic heating a fluid using said system.

Accordingly, a system for ohmic heating a fluid is provided, wherein the system comprises

- at least one chamber for receiving the fluid;
- at least two units each comprising at least one electrode, wherein each of the at least one electrode is associated to at least one means for galvanic separation,
- wherein the electrodes of each of the two units are disposed in the chamber at a distance apart from one another and the means for galvanic separation are disposed outside of the chamber; and
- at least one frequency inverter that is electrically connected to at least two electrode-units for operating the at least two electrode-units.

The concept, on which the present system is based, uses the properties of reactive electrical components (capacitors, coils and transformers) as means for galvanic separation. The inverter is used for transforming the frequency of the mains voltage from 50-60 Hz to a higher frequency of over 200 kHz up to 3 MHz. The reactive components are used for separating the liquid in a galvanic manner and for regulating the generated heating performance. This is realized by adapting the inverter frequency. In addition to the regulation of the heating performance the alteration of electric conductance can be considered. This has the advantage that no voltage transformation is required (as suggested in U.S. Pat. No. 6,522,834 B1) and the number of electrodes can be reduced drastically in order to cover a larger working range. In addition, the requirement for separating the liquid mechanically or for using a grounding electrode lapses since the leakage current is sufficiently reduced by the galvanic separation of the reactive components. Furthermore, the current density can be increased in the liquid and the electrodes since corrosion/electrolysis do not only depend on current density but also on the frequency of the applied voltage/current. Thus, the advantage of using reactive components is a cost-efficient compact construction with a high energy density.

The system according to the proposed solution can also be described as an electric heating system for a fluid, such as water or milk or any other suitable fluid, using a frequency inverter, wherein the mains voltage is chopped by the frequency inverter into multiple high-frequency portions in order to increase the voltage frequency and decoupling or delinking the electrodes by means of suitable galvanic separation means as for example capacitors. In addition, multiple of such systems with different electrode distances can be cascaded or arranged one after the other in order to cover a larger conductivity range of the fluid passing the heating chamber.

Each or multiple electrodes is/are associated (e.g. connected) to one galvanic separation means forming an electrode-galvanic separation means-unit (for example an electrode-capacitor unit), respectively. The electrode-galvanic separation means-unit are in turn electrically connected to the frequency inverter (or frequency chopper) that operates the at least two electrode-galvanic separation means-units.

In the context of the proposed solution a frequency inverter is defined as an element that can alter the magnitude and/or frequency of the input voltage and can control the output power. Thus, the frequency inverter changes output voltage frequency and magnitude to vary power output.

A frequency inverter is also called frequency converter. It is a power conversion device to convert mains power (for example of 50 Hz or 60 Hz) to another frequency power by inner power semiconductor on/off behaviors. The frequency inverter may consist of a rectifier (AC to DC), filter, inverter (DC to AC), detection unit and microprocessing unit etc. Where the control circuit controls the power circuit. The rectifier circuit converts AC power into DC power, the DC intermediate circuit smooths the rectifier circuit output, then the inverter circuit reverses the DC current into AC current again.

The system according to the proposed solution allows to build a high-power density device due to the galvanic separation and prevention or reduction of electrolysis of the fluid to be heated.

Mains voltages are always linked to the ground potential. This causes a current flow when another object that is linked to the ground potential comes into contact with the mains voltage, as for example in case of the human standing on the ground. In order to unlink the mains voltage from the ground potential and in order to prevent the current flow in case of a contact, a galvanic separation is typically used. Nowadays, typically used means for galvanic separation are expensive, large and heavy if operated at the mains frequency, being the reason that it is not used in current ohmic heating systems.

The system according to the proposed solution makes use of a frequency inverter operating at a much higher frequency that allows to employ galvanic separation means in a cost-efficient and compact way. The resulting system is more compact, cost-effective and is galvanically separated in contrast to current heating systems.

As mentioned above, electrolysis causes a separation of molecules in a fluid, when a voltage with a constant polarization is applied to electrodes that are in contact with the fluid. This effect arises faster if the energy flow through the fluid is increased. In order to counteract this process the polarization of the voltage can be reversed. In case of a mains voltage with a frequency of 50 to 60 Hz depending on the country the energy density in the fluid needs to be sufficiently small to avoid electrolysis. However, a voltage with such a low frequency requires the use of multiple electrodes or a large electrode surface in order to transfer the required energy into the fluid. In contrast, the present system avoids the use of multiple electrodes or large electrode surfaces to transfer the required amount of energy in that the mains frequency is increased or chopped to a higher frequency.

The dimensions of the heater (in particular heating chamber) are adapted according to the fluid to be heated and the maximum performance. Each liquid has a different conductivity value σ that allows the determination of the average resistance R of the fluid in the heating chamber according to equation 1. The resistance R depends on the average electrodes distance $\bar{d}$ and the electrode surface A:

$$\bar{R} = \frac{\bar{d}}{\sigma \cdot A} \tag{1}$$

The generated heating performance $P_{Heat}$ can be determined by means of the effective value I of the current flowing through the liquid with the resistance R; or the applied effective value of the voltage U:

$$P_{Heat}=I^2 \cdot R=U \cdot I \tag{2}$$

The temperature change of the liquid with mass flow $\dot{m}$ and the specific heat capacity $c_v$ between inlet and outlet of the heating chamber can be calculated based on the generated heating performance:

$$\Delta T = \frac{P_{Heat}}{\dot{m} \cdot c_v} \tag{3}$$

The output temperature $T_{out}$ can be regulated by means of a current sensor, which measures the input current I, and a temperature sensor before and after the heating chamber, which measure the input temperature $T_{in}$ and the output temperature $T_{out}$:

$$T_{out} = \Delta T + T_{in} = \frac{I \cdot U}{\dot{m} \cdot c_v} + T_{in} \tag{4}$$

In order to protect the user or other devices from leakage currents the leakage currents are limited by the reactive coupling element (or means for galvanic separation).

A further embodiment is provided, wherein the at least one electrode of each unit is associated with at least one means for galvanic separation (for example a capacitor) or wherein the electrodes of each unit are associated to one common means for galvanic separation (for example a transformer).

Thus, in an embodiment of the present system the at least one means for galvanic separation or galvanic isolation is at least one capacitor or at least one isolation transformer. If a capacitor is used it may be a safety capacitor (also designated as X- or Y-class capacitor). If a transformer is used for galvanic separation and power control, preferably it features a voltage ratio of 1:1 for optimal volume usage, what is different to a voltage doubler with a ratio of 1:2 as described in U.S. Pat. No. 6,522,834 B1.

Capacitor as Means for Galvanic Separation

The functionality of a system using capacitors with a capacitance C and rectified mains voltage as supply voltage is illustrated in the following.

The heat performance $P_{Heat}$ can be calculated using equation (5), wherein R is the fluid resistance, $U_{net}$ is the mains voltage, $f_p$ is the pulse frequency, Xc the capacitive reactance and $C_{eq}$=C/2 is the equivalent capacitance of the two capacitors connected in series.

$$P_{Heat} = I^2 \cdot R,\ I = \frac{U_{net}}{\sqrt{R^2 + X_C^2}},\ X_C = \frac{1}{2 \cdot \pi \cdot f_P \cdot C_{eq}} \tag{5}$$

The maximum leakage current, which could flow, can be determined using equation (6), wherein $f_{net}$ is the mains frequency and C the capacitance of the coupling capacitor:

$$I_L = \frac{U_{net}}{X_{Cnet}},\ X_{Cnet} = \frac{1}{2 \cdot \pi \cdot f_{net} \cdot C} \tag{6}$$

According to equation (6) the heat performance $P_{Heat}$ can be altered by altering the pulse frequency by means of controlling the current using the capacitive reactance Xc. This allows for a response to an alteration of the conductivity value σ or to change the heat performance itself. It is of an advantage to use specific safety capacitors (X- or Y-class capacitor).

Transformer as Means for Galvanic Separation

The functionality of the system is analogue when using a transformer and rectified mains voltage as supply voltage as illustrated in the following. The behaviour of the used real transformer can be completely described with an equivalent circuit of two inductors L1 and L2 and an ideal transformer T (see FIG. 2H). The inductances of the coils are determined by construction and geometry of the transformer. Having a transfer ratio of 1:1 the heat performance can be determined using equation (7), where R is the fluid resistance:

$$P_{Heat} = \frac{U_{net}^2 \cdot R}{\frac{(L_1 - L_2)^2}{L_2^2} R^2 + L_1^2 \cdot \omega^2},\ \omega = 2 \cdot \pi \cdot f_p \tag{7}$$

The leakage current of the transformer results from the construction related parasitic capacitance which is normally small enough to be neglected. According to equation (7) the heat performance can be governed by controlling the pulse frequency $f_p$ or it can be responded to changes of the fluid conductivity.

When using reactive components as coupling elements or as means for galvanic separation the heat performance to be transferred is limited. In order to improve this behaviour, the coupling can be extended using further reactive components (or additional elements) to form a resonant coupling.

These additional elements may be arranged in parallel or in series and may be one or more of the following:

if capacitors are used for galvanic separation it is preferred if at least one inductive element (such as a coil or transformer) is associated therewith;

if a transformer is used for galvanic separation it is preferred to optimize the transfer behaviour by using additional capacitors and/or induction coils in series or parallel connection;

Thus, in an embodiment of the system multiple reactive components can be combined for obtaining a resonant behaviour and improving the transfer properties of the reactive components. This has the advantage that the inverter recognizes only the fluid as load resistance and no significant reactive components, which reduce the transfer efficiency. In order to achieve this the resonant coupling has to be triggered close to the resonance frequency.

Resonant Coupling Using Capacitors with Inductors

The extension of the capacitor coupling can be done by means of a serial connection of coils with the inductance L to a resonant coupling. The converted heat performance with a resonant coupling can be determined using equation (8), wherein $L_{eq}$=2L is the equivalent inductance value for two coils connected in series, $C_{eq}$=C/2 is the equivalent capacitance of the two capacitors connected in series:

$$P_{Heat} = I^2 \cdot R, \tag{8}$$

$$I = \frac{U_{net}}{\sqrt{R^2 + \left(\omega L_{eq} - \frac{1}{\omega C_{eq}}\right)^2}},$$

$$\omega = 2 \cdot \pi \cdot f_p$$

If the pulse frequency is selected exactly at the resonance frequency $f_R$ (see equation 9), the reactance $X_L = \omega L_{eq}$ and $$X_c = \frac{1}{\omega C_{eq}}$$

of the reactive components cancel each other and the heat performance can be determined by means of equation (10):

$$f_R = \frac{1}{2\pi\sqrt{L_{eq} \cdot C_{eq}}} \tag{9}$$

$$P_{Heat} = \frac{U_{net}^2}{R} \tag{10}$$

The maximum leakage current can be determined by means of equation (11):

$$I_L = \frac{U_{net}}{Z_{net}}, \tag{11}$$

$$Z_{net} = \sqrt{\left(\omega_{net} L - \frac{1}{\omega_{net} C}\right)^2},$$

$$\omega_{net} = 2 \cdot \pi \cdot f_{net}$$

According to equation (10) the heat performance is not limited any longer by the reactive components due to the creation of a resonant coupling. In addition, the heat performance can still be controlled by frequency $f_p$ in order to react to conductivity changes or to control the heat performance.

Resonant Coupling Using Transformer with Capacitor

In case of coupling by means of a transformer the heat performance is also limited; see equation (7). In order to improve the transfer rate an additional capacitor with the capacitance $C_R$ can be placed in series between inverter and transformer to form a resonant coupling. The heat performance can be determined in case of a transfer ratio of the transformer of 1:1 according to equation (12):

$$P_{Heat} = \frac{C_R^2 \cdot L_2^2 \cdot \omega^4 \cdot U_{net}^2 \cdot R}{L_2^2 \cdot \omega^2(-1 + C_R L_1 \omega^2)^2 + R^2(-1 + C_R \omega^2 (L_1 + L_2))^2}, \tag{14}$$

$$\omega = 2 \cdot \pi \cdot f_p$$

If the pulse frequency is chosen at a resonance frequency according to equation (13)

$$f_R = \frac{1}{2\pi\sqrt{L_1 \cdot C_R}} \tag{15}$$

The reactive components cancel each other and the heating performance is simplified to $$P_{Heat} = \frac{U_{net}^2}{R} \tag{16}$$

Equation (14) shows that due to generating a resonant coupling the heat performance is not limited any longer by the reactive components. In addition, the heat performance may be governed by the frequency $f_p$ for responding to changes of fluid conductivity.

In yet a further embodiment it is possible to add multiple electrode pairs or segmented electrode pairs for example by means of switches, for example electro-mechanical relays, in order to extend the conductivity range, in which the system operates reliable, even further. In case of multiple electrode pairs the singular electrode pairs are electrically separated from each other by insulation. In case of a segmented electrode pair only one electrode is segmented while the opposite electrode is not segmented and still continuous or complete.

For example, the resistance of the fluid $R_{eff}$ can be divided in half by switching on a second equivalent electrode pair (see equation 15). Thereby the resistance of the fluid can be adjusted back to the working range in case said range becomes too large. The different realizations of the electrode surfaces $A_i$ and the distances $d_i$ also allow for further separations of the fluid resistance.

$$R_{eff} = \frac{1}{\frac{1}{R_1} + \frac{1}{R_2}} = \frac{R_1 + R_2}{4}, \; R_1 = R_2 = \frac{d_i}{\sigma \cdot A_i} \tag{15}$$

In another embodiment it is also possible to reduce the pulse time in order to regulate and control the heat performance. This can be done by altering the activation time $T_{On}$ of the trigger pulses. Thereby the total amount of time $$T_P = \frac{1}{f_P}$$

of the pulse of the pulse frequency remains constant.

The overall pulse is composed of four steps. At first the voltage is applied in one direction for the time $T_{On}$. This is followed by a waiting period $$\frac{T_P}{2} - T_{On}$$

until the voltage is applied again in the opposite direction for the time $T_{On}$. Subsequently, there is a further waiting period until the complete time $T_P$ is lapsed until a new pulse is applied.

In yet another embodiment of the present system a cooling unit is implemented for maximizing the efficiency of the heating system. The cooling unit for the electronic components uses the characteristics of the system and optimizes the efficiency.

A cooling of electronic components is in general necessary since at high performance and high frequency operating losses occur which generate heat that may result in overheating the components resulting in a system failure. In order to cool the components said components are installed on a cooling body which offers a larger surface for dissipating heat. The heat is typically dissipated through the air by means of convection or forced convection. In case of forced convection the air is dissipated from the cooling body by means of a fan thus increasing the heat dissipation.

It is also possible to use a cooling liquid for increasing the heat dissipation even further. In an embodiment of the present system the cooling unit or cooling body is placed in front of the heating chamber such that the cold fluid that is to be heated at first flows pass the cooling unit and is thereby pre-heated before entering the heating chamber. This principle allows an effective cooling of the electronics and at the same time a pre-heating of the fluid. This increases the efficiency of the whole system since the heat (power loss) is not emitted to the environment but rather to the fluid to be heated.

In an embodiment of the system according to the proposed solution the at least one chamber (i.e. heating chamber) is a container, a vessel or a tube having in each case at least one inlet and at least one outlet for the fluid. A continuous flow of the fluid through the chamber is preferred. The present system may also be used for stagnant or non-flowing fluids. However, this may lead to overheating of the fluid.

As mentioned above any fluid may be heated by the system according to the proposed solution as long as the fluid has a certain electrical conductivity that allows current to flow through it. The electrical conductivity of the fluid to be heated is a requirement for the application of the present system.

In a further embodiment of the system at least one anode and at least one cathode are provided in the chamber, wherein anode and cathode alternate temporally. The number of electrode pairs can vary and depend on the fluid to be heated. The electrode material can be of any suitable conducting material, such as aluminium.

In another preferred embodiment the at least one frequency inverter comprises at least one bridge circuit which may be designed as a full bridge or a half bridge.

It is in particular preferred, if the at least one frequency converter comprises at least one bridge circuit comprising at least one switching arrangement of at least two switches and at least one center tap, wherein the at least center tap is coupled to at least one electrode-galvanic separation means-unit.

Thus, in one specific variant of the present ohmic heating system each electrode-galvanic separation means-unit is connected or coupled to one center tap that is located or arranged between two electronic switches.

The at least one switching arrangement may comprise at least four switches, in particular in case of a full bridge. In case of a half bridge two switches are provided.

The electronic switches may be FET switches or IGBT switches. In case of four electric switches one center tap is arranged between two of the switches.

In a yet further embodiment of the present ohmic heating system each electronic switch is coupled and controlled by a control unit, wherein the at least one control unit is preferably a micro-controller. The control unit enables the control of the electronic switches such that the polarity of the voltage changes over the center tap and the electrode-galvanic separation means-unit. This generates a voltage with higher frequency. Thus, the frequency can be varied by controlling the control unit and subsequently the electric switches.

In a further embodiment of the present ohmic heating system at least one voltage supply is provided for the at least one frequency inverter.

It is preferred if the at least one voltage supply comprises a rectifier, in particular a diode rectifier. The at least one voltage supply provides a rectified voltage $U_{net}$ between 110 and 240 V and a frequency $f_{net}$ between 50 and 60 Hz.

The system according to the proposed solution is used in a method for ohmic heating a fluid with the steps of:

providing a voltage to the at least one frequency inverter by at least one voltage supplier; and controlling the at least one frequency inverter such that the polarity of the voltage alternates over the at least two electrode-galvanic separation means-units.

In particular, a voltage is provided to the at least one bridge circuit by the at least one voltage supplier; and the electronic switches of the switching arrangement are controlled by the at least one control unit such that the polarity of the voltage over the two center taps and thus the electrode-galvanic separation means-units alternates. In case of a half bridge the center tap is switched between the at least two different potentials.

Accordingly, a method is provided wherein a fluid is heated by changing or alternating the polarity of the voltage over the center taps and the electrode-galvanic separation means-units such that a voltage with higher frequency is generated.

In an embodiment the voltage applied to the frequency inverter consists of at least one bridge circuit is a rectified voltage $U_{net}$ between 110 and 240 V and a frequency $f_{net}$ between 50 and 60 Hz.

It is preferred, if the polarity of the voltage applied to the electrode-galvanic separation means—units is controlled such that a pulse frequency of up to 3 MHz is obtained. Such re-polarization and polarization changes in a frequency range of up to 3 MHz prevent electrolysis of the fluid. In a preferred embodiment a pulse frequency of about 300 kHz is obtained.

However, the applied frequency depends on the fluid to be heated and the performance of the heating system and is determined separately for every fluid and construction. Preferably, the pulse frequency is adjusted continuously to control the heating performance.

BRIEF DESCRIPTION OF THE DRAWINGS

The proposed solution is now explained in more detail by means of the following examples and with reference to the following figures.

DESCRIPTION OF THE INVENTION

It is to be understood that in all applications as illustrated by the embodiments a universal voltage source can be used.

Figure 1:
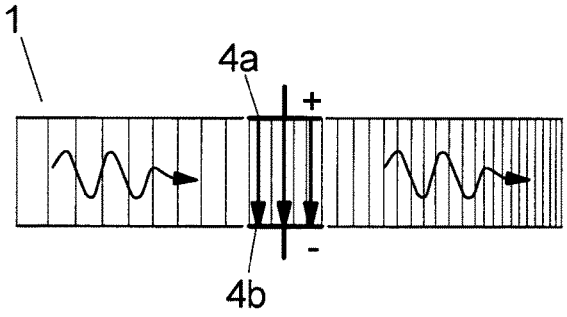
FIG. 1 shows a schematic view of the basic functioning of a resistance heater (ohmic heater)

FIG. 1 illustrates the basic principle of a resistance heater (ohmic heater). The fluid to be heated is guided in a continuous flow through the heating chamber 1. Two electrically conducting plates (electrodes 4*a*, 4*b* provided in the chamber 1) are contacted with the fluid; a voltage is supplied subsequently to the electrodes 4*a*, 4*b*. This causes a current flow through the fluid (such as water) to be heated. The fluid represents an electrical resistance causing a power loss or power dissipation. This power loss is converted in the fluid into heat. Thus, the fluid serves as heating element and the heat is generated directly in the fluid.

Figure 2A:
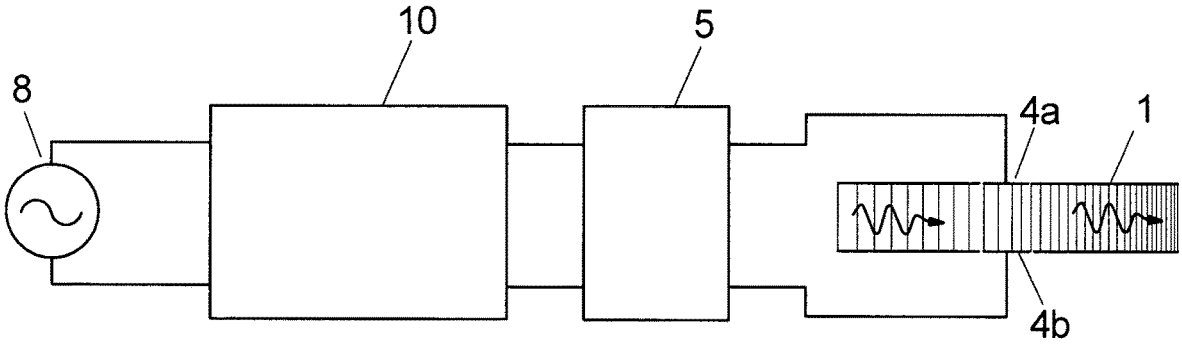
FIG. 2A shows a general schematic view of the basic functioning of a system according to the proposed solution.

FIG. 2A illustrates the basic principle of the present system. The mains voltage is chopped into multiple high frequency portions by a frequency inverter 10 in order to increase the voltage frequency. The electrodes 4*a*, 4*b* are decoupled or delinked by galvanic isolation means 5. The fluid flows through the chamber 1 and is subsequently heated when applying the mains voltage. In addition, multiple of such systems with different electrode distances can be cascaded or arranged one after the other in order to cover a larger conductivity range of the fluid passing the heating chamber.

Figure 2B:
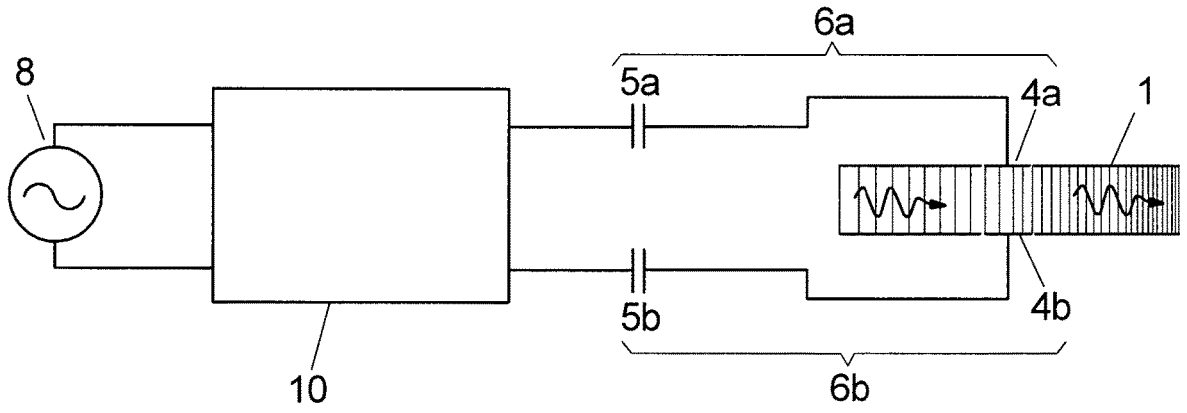
FIG. 2B shows a schematic view of a first embodiment of a system according to the proposed solution.

In the embodiment of FIG. 2B the galvanic isolation means 5 are provided as capacitors 5*a*, 5*b*. Electrodes 4*a*, 4*b* and capacitors 5*a*, 5*b* form an electrode-capacitor unit 6*a*, 6*b*, respectively.

Figure 2C:
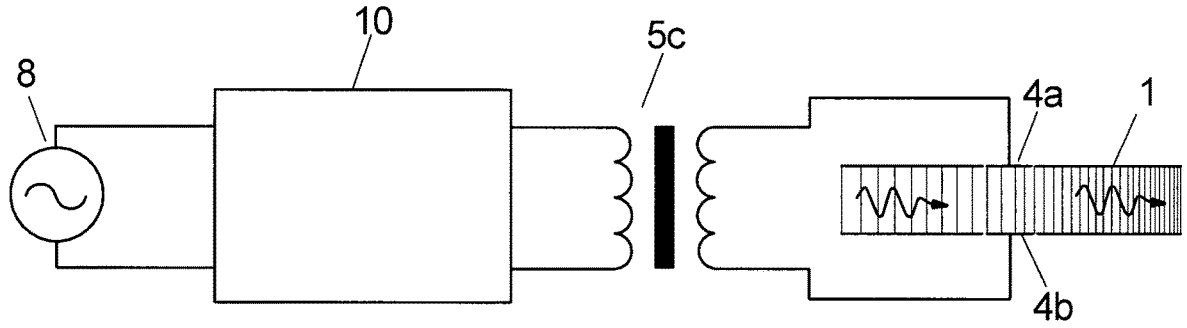
FIG. 2C shows a schematic view of a second embodiment of a system according to the proposed solution.

The galvanic isolation means 5 may also be provided as an isolation transformer 5*c* (see FIG. 2C).

The capacitors have the advantage over a transformer in that they are smaller, have less weight, cheaper and generate less power loss. The disadvantage is however that capacitors have a larger leakage current (i.e. current that flows in case of a ground fault) compared to transformers.

Figure 2D:
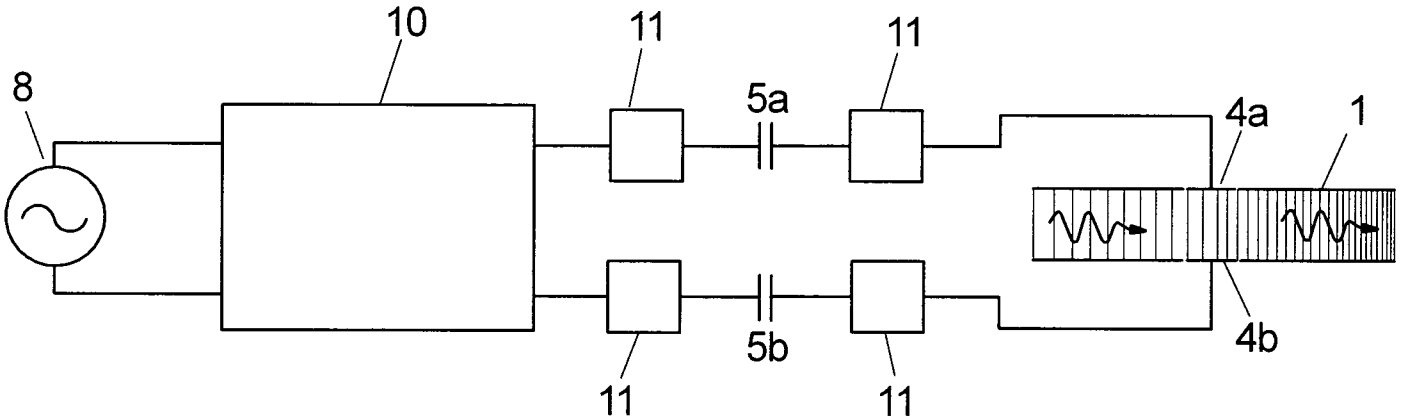
FIG. 2D shows a schematic view of a third embodiment of a system according to the proposed solution.

According to the embodiment as illustrated in FIG. 2D additional elements 11 are arranged in the electrode-capacitor path. The additional element 11 may be a coil for compensating the capacitive reactance and for increasing the converted power in the liquid. This minimizes the reactive power.

Figure 2E:
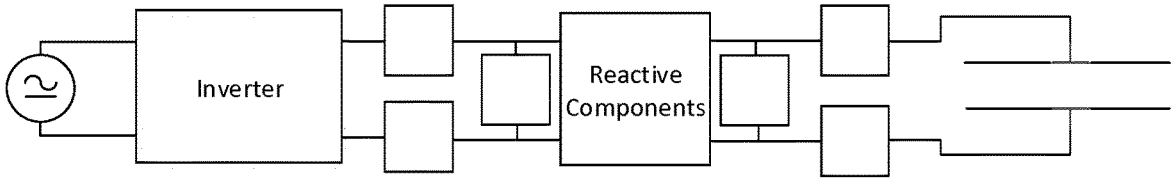
FIG. 2E shows a schematic view of a fourth embodiment of a system according to the proposed solution.

According to the embodiment as illustrated in FIG. 2E the additional elements 11 may also be arranged in parallel as well as in series.

Figure 2F:
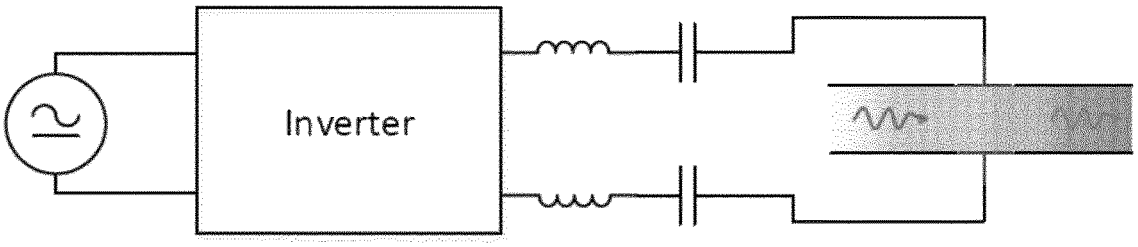
FIG. 2F shows a schematic view of a fifth embodiment of a system according to the proposed solution.
Figure 2G:
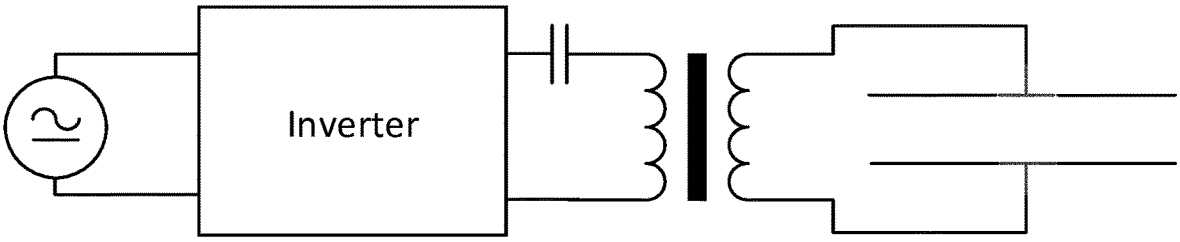
FIG. 2G shows a schematic view of a sixth embodiment of a system according to the proposed solution.
Figure 2H:
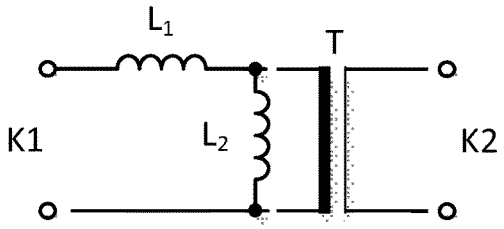
FIG. 2H shows a schematic view of a seventh embodiment of a system according to the proposed solution.

The embodiment of FIG. 2F shows a system wherein capacitors are connected to coils for resonate coupling, while the embodiment of FIG. 2G shows a system wherein a transformer is connected to an inductor-capacitor network for resonant coupling. In this way it is possible to optimize the transfer behaviour The embodiment of FIG. 2H shows an equivalent circuit diagram representing the behaviour of a real transformer utilizing two inductive coils with the inductance L1 and L2 and an ideal transformer T. The inductances of the coils are determined by construction and geometry of the real transformer. The clamps K1 are connected to an inverter and the clamps K2 are connected to electrodes of the heating chamber.

Figure 2I:
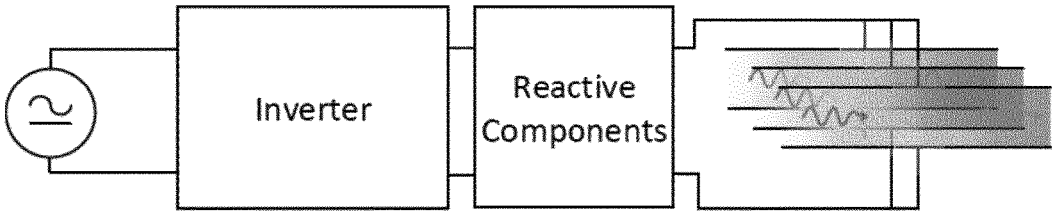
FIG. 2I shows a schematic view of an eighth embodiment of a system according to the proposed solution.

According to the embodiment of FIG. 2I it is possible to operate multiple heating chambers in parallel.

Figure 2J:
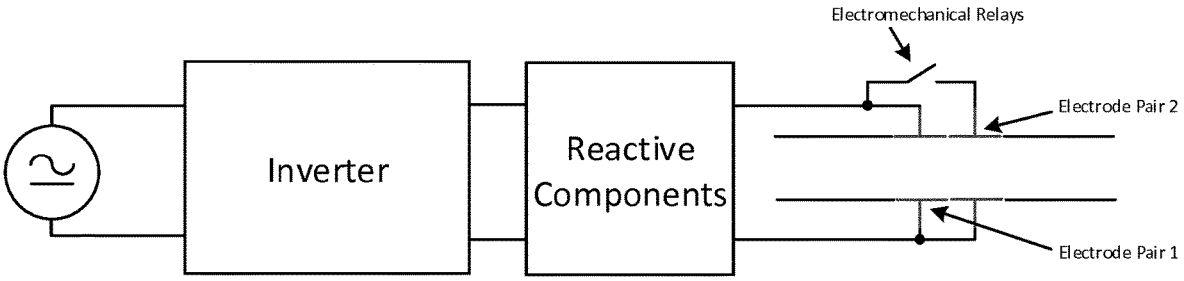
FIG. 2J schematic view of a ninth embodiment of a system according to the proposed solution.

In the embodiment of FIG. 2J multiple electrode pairs are added to the system by means of switches, for example electro-mechanical relays, in order to extend the conductivity range, in which the system operates reliable, even further.

Figure 2K:
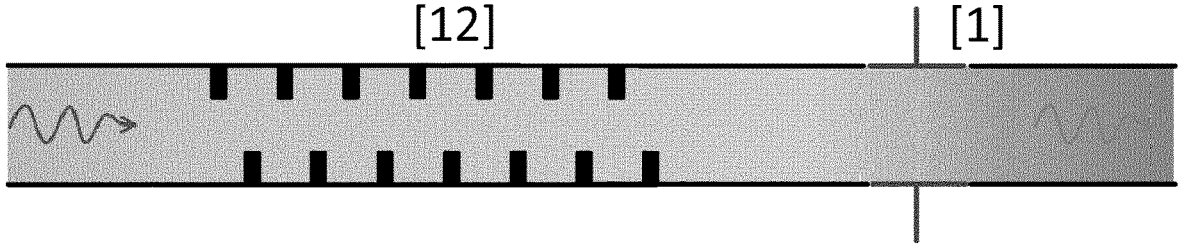
FIG. 2K shows a schematic view of an embodiment of a system according to the proposed solution with a cooling unit.
Figure 3A:
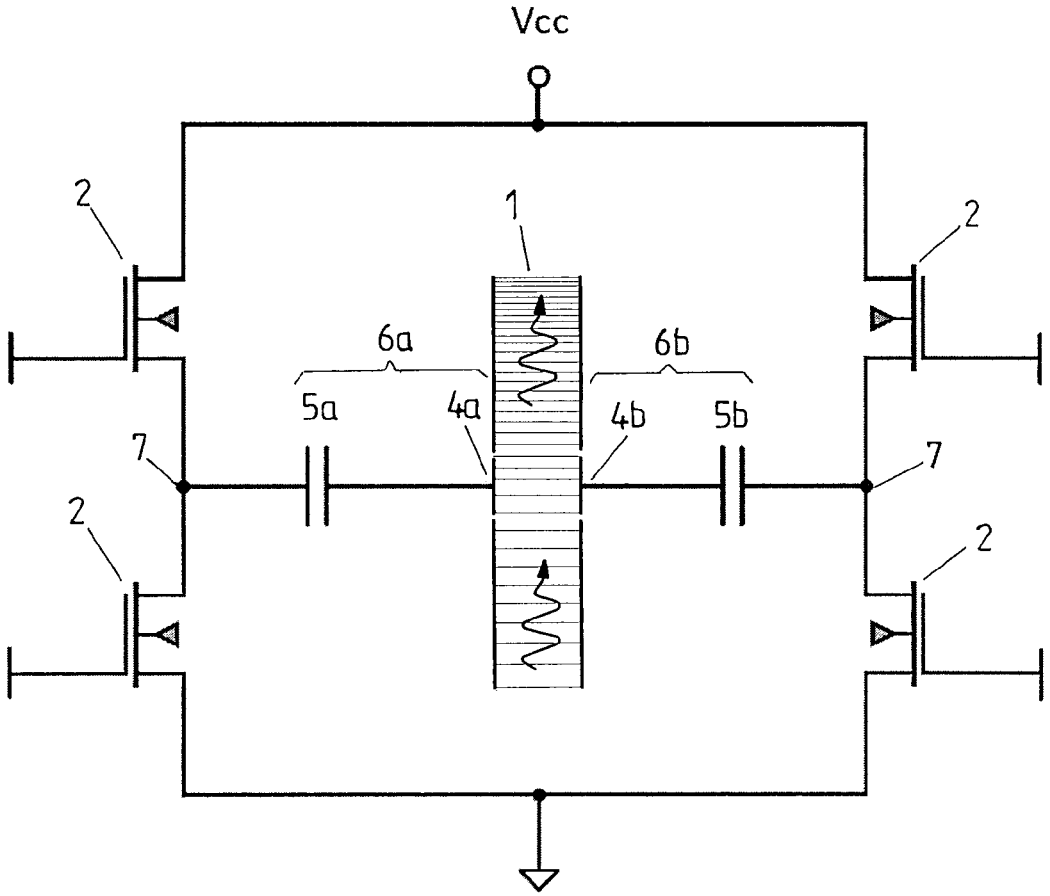
FIG. 3A shows a schematic view of full bridge comprising the system of FIG. 2B.
Figure 3B:
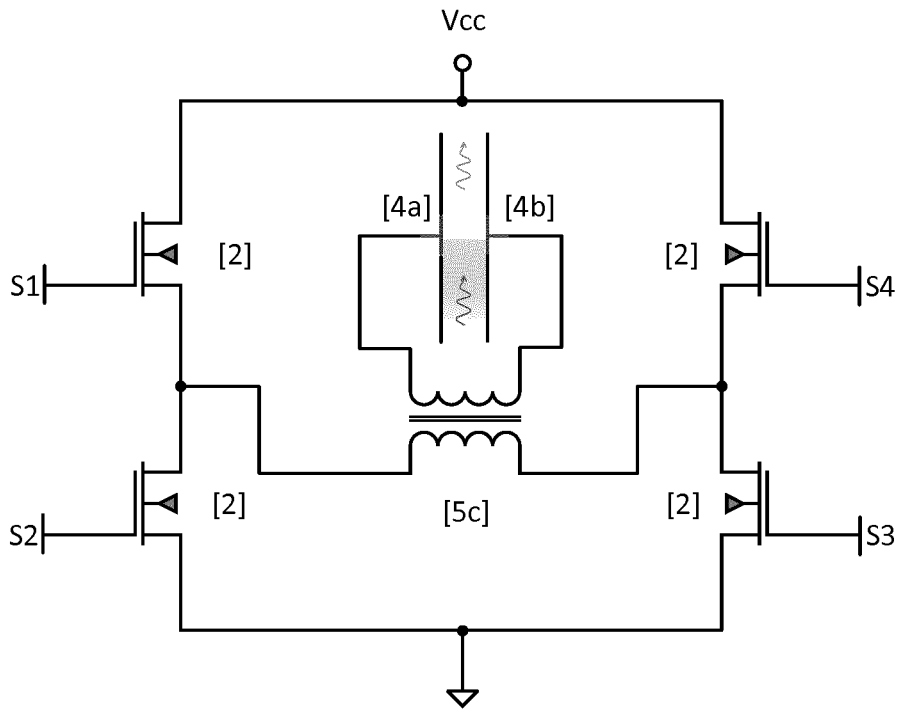
FIG. 3B shows a schematic view of full bridge comprising the system of FIG. 2C.

FIG. 2K shows an example of the system with a cooling unit. Here, the waste heat of the electrical components is used for pre-heating the fluid to be heated. The components are connected thermally to a cooling body 12 which is subsequently cooled by the incoming fluid. The pre-heated fluid flows then into the heating chamber 1 in which the fluid is heated to the desired final temperature In FIGS. 3A and 3B a full bridge arrangement as frequency inverter is illustrated. Here capacitors 5*a*, 5*b* as galvanic separation means (FIG. 3A) or isolation transformer 5*c* as galvanic separation means (FIG. 3B) are coupled to respective electrodes 4*a*, 4*b* forming an electrode-capacitor unit 6*a*, 6*b* or transformer-electrode-pair unit.

Figure 6:
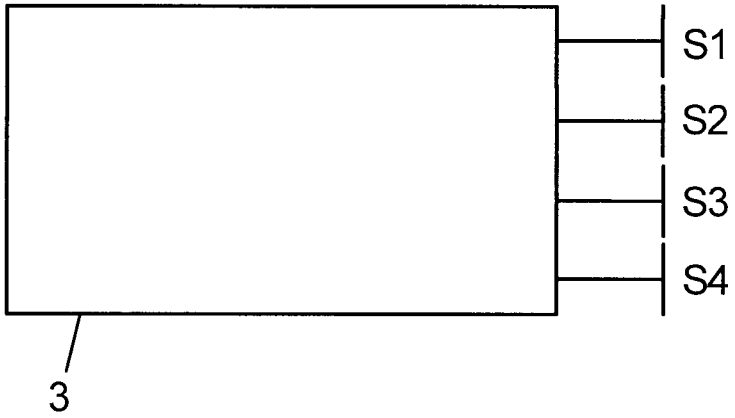
FIG. 6 shows a schematic view of a control unit.

Each of the electrode capacitor units 6*a*, 6*b* (or transformer-electrode-pair unit) is in turn linked and controlled by a switching arrangement comprising four switches 2 with one center tap 7 between two switches. The switches 2 are controlled by the control unit 3 (see FIG. 6) that is linked to every switch separately by S1, S2, S3, S4.

Figure 5:
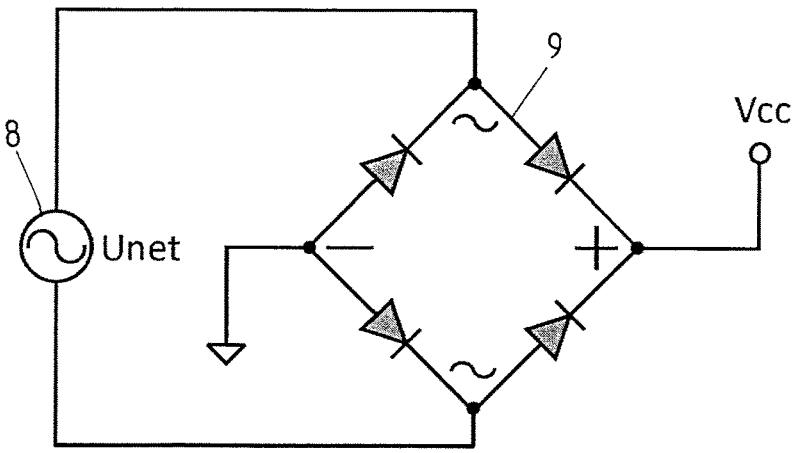
FIG. 5 shows a schematic view of a voltage supply.

The mains voltage to the circuit is provided by a voltage supply 8 (see FIG. 5). The mains voltage is rectified by using a rectifier 9 in form of a diode rectifier.

Figure 4:
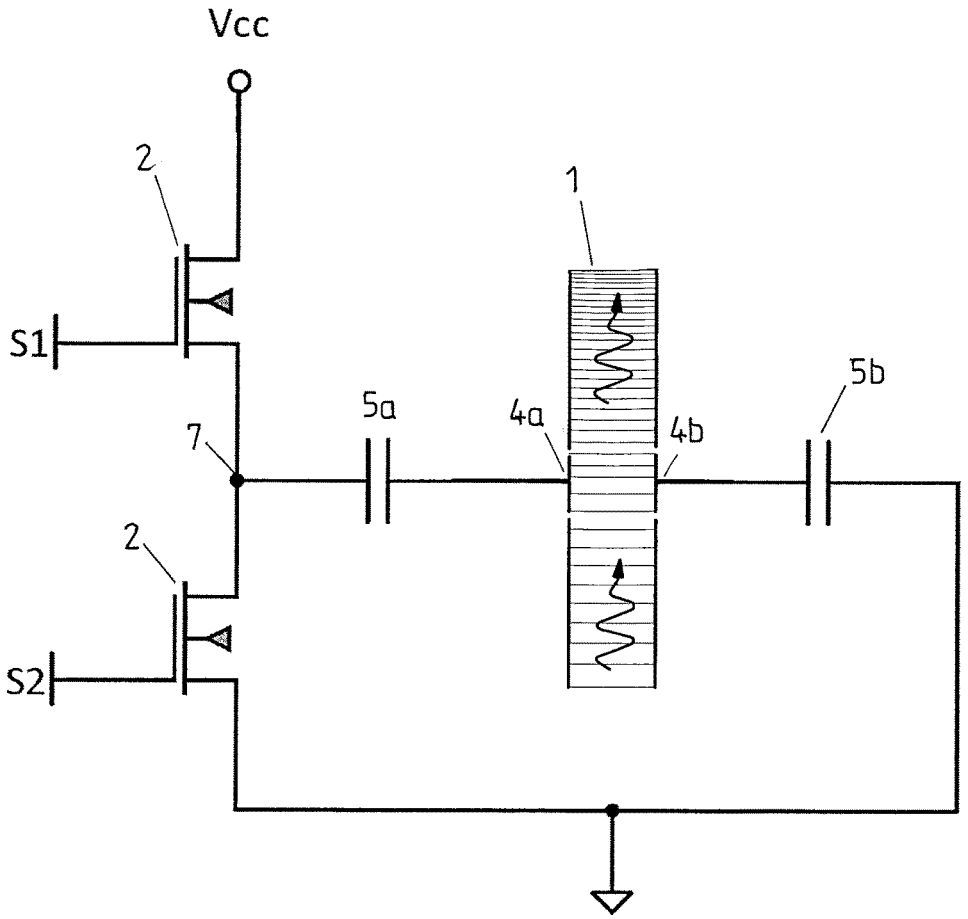
FIG. 4 shows a schematic view of a half bridges comprising the system of FIG. 2B.

In FIG. 4 a half bridge arrangement as frequency inverter is illustrated. Such a half bridge arrangement comprises in contrast to the full bridge arrangement only two switches. The center tap 7 is laid either onto the lower potential or the higher potential for alternating the voltage and frequency chopping.

Example 1

The frequency inverter according to the proposed solution is made of a bridge circuit with four electronic switches (S1, S2, S3, S4) such as FET, e.g. IGBT and others (see FIG. 3). The bridge circuit may be realized as a full bridge or half bridge.

There are center taps between two switches, namely one center tap between switches S1 and S2 and a second center tap between switches S3 and S4.

A mains voltage of 110 to 240 V with a mains frequency of 50 to 60 Hz is applied to the circuit. The mains voltage is rectified by using a rectifier in the form of a diode rectifier.

The electronic switches are controlled by a microcontroller in the way that the polarity of the voltage alternates over the center taps. This creates a voltage with the same magnitude as the mains voltage but with an increased frequency.

Figure 7:
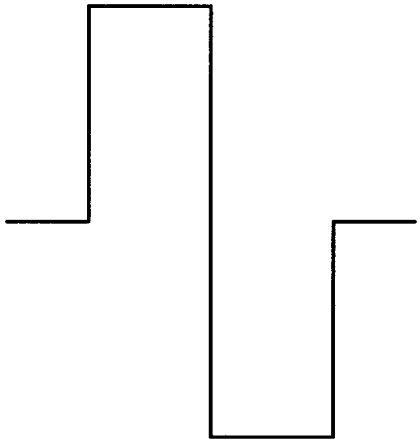
FIG. 7 shows an example of a pulse frequency generated and applied by the system according to the proposed solution.

The frequency can be changed by controlling the microcontroller. A frequency $f_p$ of more than 200 kHz, preferably 300 kHz (FIGS. 6, 7) is applied for ohmic heating for repolarization in order to prevent electrolysis. The applied frequency depends however on the liquid and the performance of the heater and has to be determined for each new set up.

The electrodes and the capacitors (or transformer) are linked to the center taps off the bridge circuit. The electrodes can consist of any suitable material, for example aluminum.

Example 2

Applications of an Ohmic Heating Device in Coffee Machines

In state of the art coffee machines a variety of heating mechanisms are used to heat the required liquids or to produce steam. These mechanisms range from gas boilers, electric boilers, steam injection or mixing of the liquid at two different temperatures.

Figure 8:
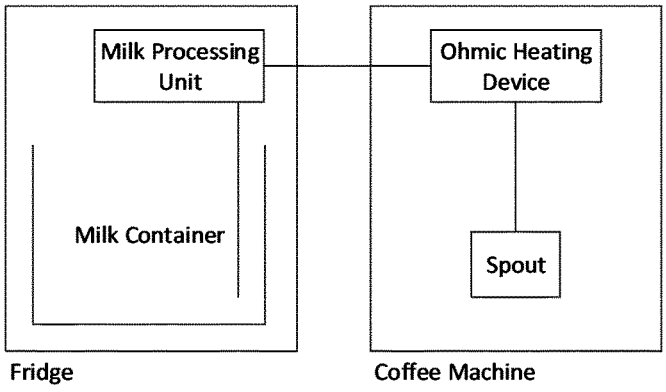
FIG. 8 shows a use of the system according to the proposed solution in a milk heating set up.

With the new continuous-flow heating device based on the Ohmic heating technology according to the proposed solution an alternative is now available to heat the various liquids such as water, milk, milk foam or syrup. In order to produce the four variations of the added milk; cold/hot milk and cold/hot milk foam with a single system, one can use the Ohmic heating device after a milk processing unit capable of foaming the milk in a cold state or just delivering cold milk as depicted in FIG. 8.

The Ohmic heating device must not necessarily be placed in the coffee machine and could be placed somewhere after the milk processing unit. Therefore, with this setup all four milk products can be generated by turning the two modules in different combinations on or off. This gives the advantage that the required milk products can be delivered in a simple and streamlined setup without the need of bypassing the heating device or using a steam injection mechanism as needed by state of the art solutions.

To provide water at the various temperatures that the coffee machine requires to deliver the different types of products such as coffee, tea water, steam or powder products; either a boiler, flow heater, a mixture of hot and cold water or a combination of the mentioned preparation methods is used as of today.

Figure 9:
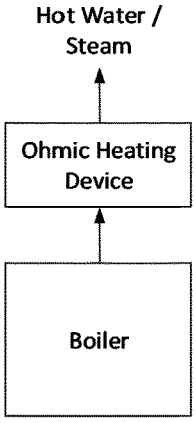
FIG. 9 shows a use of the system according to the proposed solution in a booster application.
Figure 10:
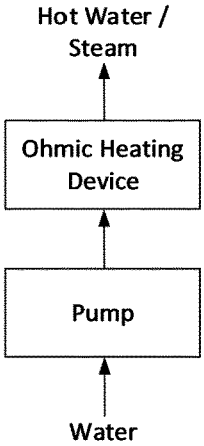
FIG. 10 shows a use of the system according to the proposed solution in a continuous flow heater set up.

With the Ohmic heating device according to the proposed solution water preparation can be simplified by using it as a booster stage after a conventional boiler or as a standalone continuous-flow heater as shown in FIG. 9 and FIG. 10.

The advantages of using the Ohmic heating device over current solutions to heat water is the ability to set a precise outlet temperature, instant variation of the outlet temperature, no standby power consumption and less maintenance due to drastically reduced scaling of the heating device.

The aforementioned setup with the Ohmic heating device can also be used to generate steam by superheating the water which turns into steam when released to atmospheric pressure.

The invention claimed is:

1. A system for ohmic heating of a fluid comprising (a) at least one chamber for receiving the fluid;

(b) at least two units each comprising at least one electrode, wherein each of the at least one electrodes is associated with at least one means for galvanic separation, wherein the electrodes of each of the two units are disposed in the chamber at a distance apart from one another and the means for galvanic separation are disposed outside of the chamber;

(c) at least one frequency inverter that is electrically connected to the at least two electrode-units for operating the at least two electrode-units, and configured to transform the frequency of the applied voltage to a frequency of over 200 kHz; and (d) a cooling unit placed in front of the heating chamber such that the fluid to be heated passes the cooling unit and is thereby pre-heated before entering the heating chamber, wherein the system is configured to adjust the pulse frequency continuously to control the heating performance.

2. The system according to claim 1, wherein the at least one means for galvanic separation is at least one capacitor or at least one isolation transformer.

3. The system according to claim 2, wherein the at least one capacitor is a safety capacitor also designated as X- or Y class capacitor.

4. The system according to claim 1, wherein additional elements are provided in one or each of the electrode-galvanic separation means-units.

5. The system according to claim 4, wherein one or more additional capacitors are provided as additional elements, preferably in series or parallel connection to form a resonate network, or one or more coils in series or parallel connection to form a resonate network are provided as additional elements, or sensors for optimizing the switching behaviour, for measuring the received power or the temperature of the fluid are provided as additional elements.

6. The system according to claim 1, wherein multiple electrode pairs are provided.

7. The system according to claim 1, wherein the at least one frequency inverter comprises at least one bridge circuit.

8. The system according to claim 1, wherein the at least one frequency converter comprises at least one bridge circuit comprising at least one switching arrangement of at least two switches and at least one center tap, wherein the at least one center tap is coupled to at least one electrode-galvanic separation means-unit.

9. The system according to claim 8, wherein the at least one switching arrangement comprises at least four switches, in particular in case of a full bridge.

10. The system according to claim 8, wherein each electronic switch of the switching arrangement is coupled to at least one control unit.

11. The system according to claim 10, wherein the at least one control unit is a micro-controller.

12. The system according to claim 1, further comprising at least one voltage supply for the at least one frequency inverter, wherein in particular the at least one voltage supply comprises a rectifier, in particular a diode rectifier.

13. The system according to claim 1, wherein the at least one chamber is a container, a vessel or a tube having in each case at least one inlet and at least one outlet for the fluid.

14. A cooling unit for the electronic components of a system according to claim 1, wherein the fluid to be heated is used as cooling fluid.

15. A method for ohmic heating a fluid in a system according to claim 1, comprising the steps of:

providing a voltage to the at least one frequency inverter by at least one voltage supplier; and controlling the at least one frequency inverter such that the polarity of the voltage alternates over the at least two electrode-galvanic separation means-units.

16. The method according to claim 15, wherein a rectified voltage $U_{net}$ between 110 and 240 V and a frequency $f_{net}$ between 50 and 60 Hz is applied to the at least one frequency inverter.

17. The method according to claim 15, wherein the polarity of the voltage is controlled by the at least one control unit.

18. The method according to claim 15, wherein the polarity of the voltage is controlled such that a pulse frequency of up to 3 MHz is obtained.

19. The method according to claim 15, wherein the pulse frequency is adjusted continuously to control the heating performance.

* * * * *